US011406242B2

(12) United States Patent
Dirisala et al.

(10) Patent No.: US 11,406,242 B2
(45) Date of Patent: Aug. 9, 2022

(54) DISHWASHER WITH SOUND ATTENUATION

(71) Applicant: Whirlpool Corporation, Benton Harbor, MI (US)

(72) Inventors: Venkata Dirisala, Benton Harbor, MI (US); Daniel J. Lesko, Kalamazoo, MI (US); Aaron P. Bennett, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 190 days.

(21) Appl. No.: 16/848,182

(22) Filed: Apr. 14, 2020

(65) Prior Publication Data

US 2021/0315439 A1 Oct. 14, 2021

(51) Int. Cl.
*A47L 15/14* (2006.01)
*A47L 15/42* (2006.01)

(52) U.S. Cl.
CPC ..... *A47L 15/4209* (2016.11); *A47L 15/14* (2013.01); *A47L 15/4219* (2013.01); *A47L 15/4257* (2013.01)

(58) Field of Classification Search
None
See application file for complete search history.

(56) References Cited

U.S. PATENT DOCUMENTS

| | | | |
|---|---|---|---|
| 7,696,277 | B2 | 4/2010 | Prejean et al. |
| 10,010,237 | B1 | 7/2018 | Dirisala et al. |
| 2010/0048796 | A1 | 2/2010 | Prejean et al. |
| 2011/0232701 | A1* | 9/2011 | Colon ..... A47L 15/4246 134/198 |

FOREIGN PATENT DOCUMENTS

| | | | |
|---|---|---|---|
| CA | 2579597 | A1 | 3/2006 |
| DE | 4227957 | A1 | 2/1994 |
| DE | 10118632 | A1 | 10/2002 |
| DE | 102005061805 | A1 | 6/2007 |
| DE | 102011085190 | A1 | 2/2013 |
| DE | 102013222573 | A1 | 5/2015 |
| DK | 2554091 | T3 | 6/2017 |
| EP | 2554091 | A1 | 6/2013 |
| EP | 2870906 | A1 | 5/2015 |
| ES | 2624772 | T3 | 3/2017 |
| HR | P20170830 | | 8/2017 |
| HU | E034577 | T2 | 10/2011 |
| JP | 2011167426 | A | 9/2011 |
| SI | 2554091 | T1 | 10/2011 |
| WO | 200602294 | A1 | 3/2006 |
| WO | 2013017583 | A1 | 2/2013 |

OTHER PUBLICATIONS

European Patent Office, Extended European Search Report re Corresponding Application No. 201168443.6-1016, dated Aug. 16, 2021, 7 pages, Munich, Germany.

* cited by examiner

*Primary Examiner* — Levon J Shahinian
(74) *Attorney, Agent, or Firm* — McGarry Bair PC

(57) ABSTRACT

A dishwasher having a treating chamber with one or more sprayers through which liquid is recirculated into the treating chamber, whereby the impact of the spray emitted from the sprayers impacts the structure forming the treating chamber to generate noise. Damping material is applied to structure forming the treating chamber to reduce the sound level of the impact exterior of the dishwasher.

16 Claims, 8 Drawing Sheets

DISHWASHER WITH SOUND ATTENUATION

TECHNICAL FIELD

This disclosure relates to dishwashers, and, more particularly to a dishwasher having sound attenuation.

BACKGROUND

Contemporary automatic dishwashers for use in a typical household include a tub defining a treating chamber with an access opening closed by a closure. One or more dish racks are provided within the treating chamber for holding dishes to be treated. The dish washer further includes a spraying system for recirculating liquid throughout the tub to remove soils from dishes and utensils. The spraying system can include a pump fluidly coupled to one or more sprayers in the treating chamber to affect the recirculation of liquid in the treating chamber through the sprayers, thereby emitting a liquid spray into the treating chamber. Sound can be generated by the mechanical operation of the pump and sprayers, as well as the impacting of the sprayed liquid against the tub and closure.

There are at least two sources of sound related to the impacting of the sprayed liquid. One such source of sound is the direct impacting of the sprayed liquid on the sides and/or closure of the dishwasher, which generates sound that can be heard by humans in the environment surrounding the dishwasher.

Another such source of sound is from the sprayed liquid which impacts the liquid on a bottom or floor of the tub as it falls for drips from the dishracks and the dishes in the dishracks. The falling/dripping liquid is often referred to as the "rainfall" sound, which can be heard by humans in the environment surrounding the dishwasher.

BRIEF DESCRIPTION

The disclosure relates to a dishwasher comprising: a tub having at least an upper wall and a lower wall, with a side wall extending between the upper wall and lower wall, with the upper, lower, and side wall at least partially defining a treating chamber with an access opening, a cover selectively closing the access opening in response to relative movement between the cover and the tub, a dish rack located within the treating chamber, a liquid recirculation circuit having at least one sprayer emitting recirculated liquid into the treating chamber and defining a first spray impact zone on the side wall, a second spray impact zone on the cover, and a rainfall zone on the lower wall, and a constrained layer damping (CLD) material located at the first spray impact zone, second spray impact zone, and the rain fall zone.

Another aspect of the disclosure generally relates to a dishwasher comprising, a metal tub having at least an upper wall and a lower wall, with a side wall extending between the upper wall and lower wall, with the upper, lower, and side wall at least partially defining a treating chamber with an access opening, a hingedly mounted door selectively closing the access opening in response to relative movement between the cover and the tub, a lower dish rack located within the treating chamber above the lower wall, an upper dish rack located within the treating chamber above the lower dish rack, a liquid recirculation circuit having a lower sprayer located below the lower dish rack, an upper sprayer located below the upper dish rack and above the lower dish rack, with each of the lower and upper sprayers emitting recirculated liquid into the treating chamber and defining a first spray impact zone on the side wall, a second spray impact zone on the cover, a rainfall zone on the lower wall, and a constrained layer damping (CLD) material located at the first spray impact zone, second spray impact zone, and the rain fall zone.

DETAILED DESCRIPTION

Figure 1:
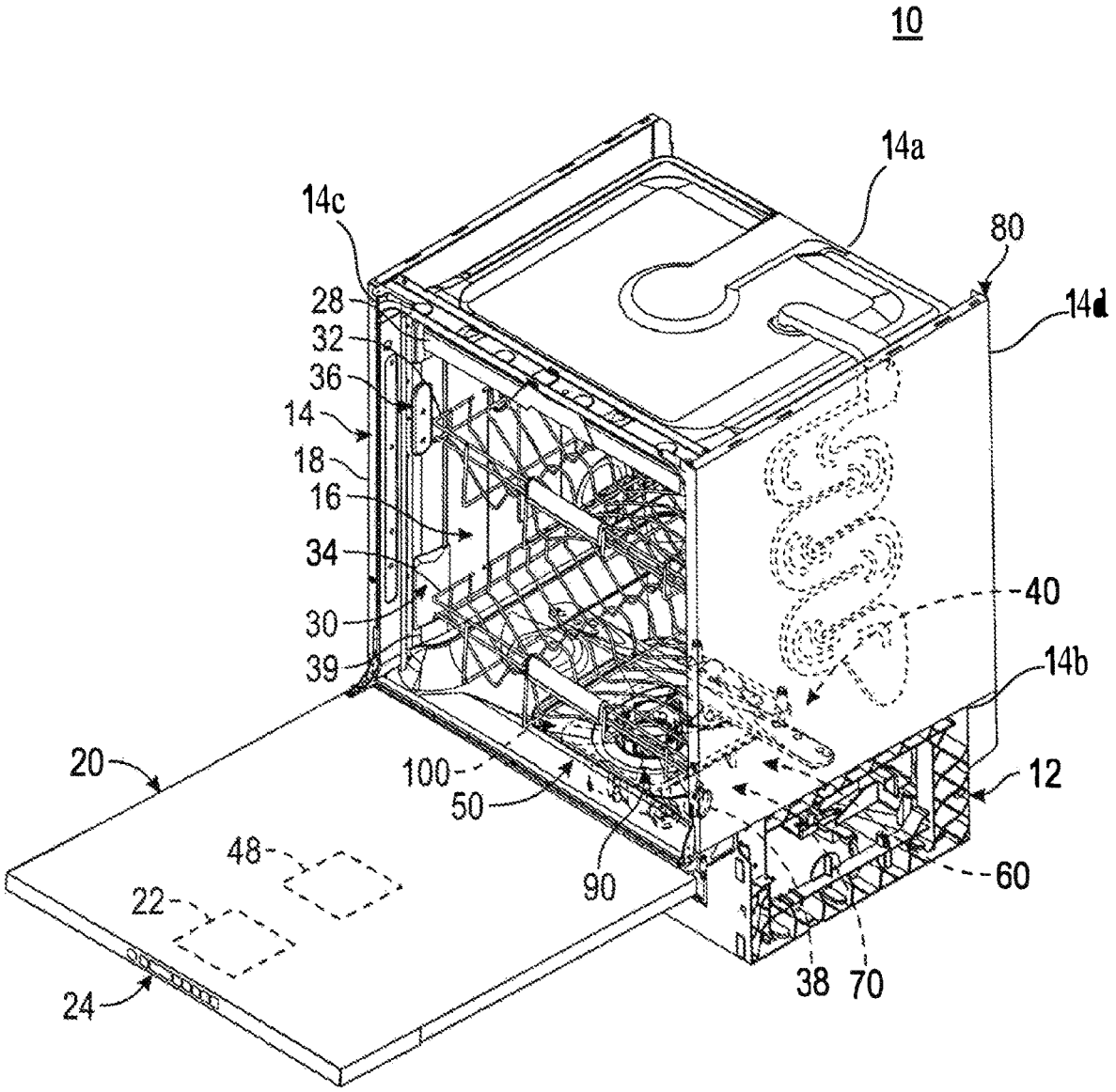
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported an open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items. The tub 14, as illustrated, has a top wall 14*a*, bottom wall 14*b*, side walls 14*c* and rear wall 14*d*, with the side walls and rear wall forming a peripheral side wall. These walls 14*a-d* collectively define the open face 18.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can include the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks", which are located within the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in side walls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. The height of the third level rack can be such that a typical glass can be stood vertically or oriented at an angle in the third level rack 28, while the third level rack 28 can still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
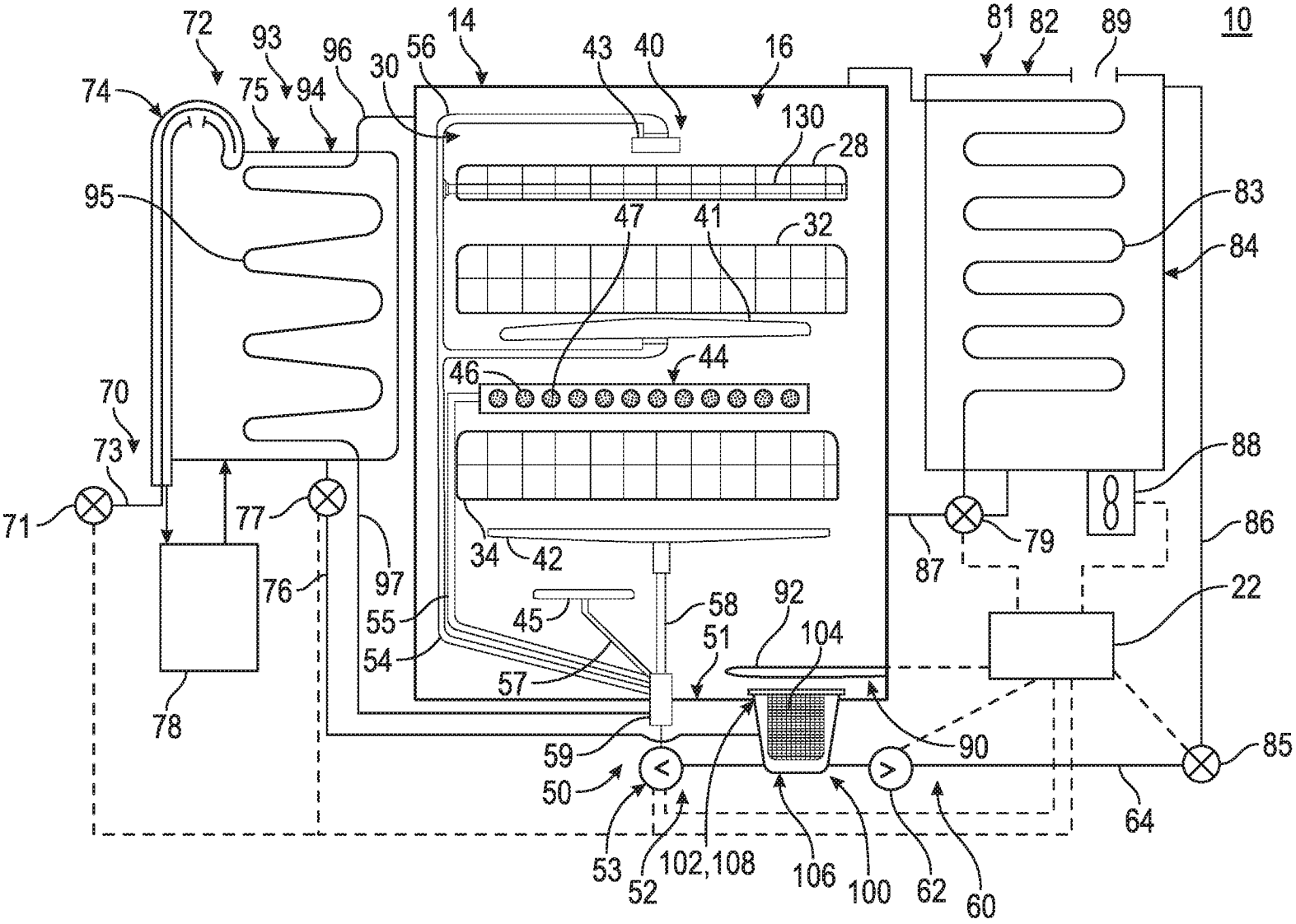
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, the sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would likely be located along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders where deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent to any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as a recirculation pump 53. The sump 51 can also be a separate module that is affixed to the bottom wall and include the pump assembly 52.

Multiple supply conduits 54, 55, 56, 57, 58 fluidly couple the sprayers 28-44 to the recirculation pump 53. A recirculation valve 59 can selectively fluidly couple each of the conduits 54-58 to the recirculation pump 53. While each sprayer 28-44 is illustrated as having a corresponding dedicated supply conduit 54-58 with one or more subsets, comprising multiple sprayers from the total group of sprayers 28-44, which can be supplied by the same conduit, negating the need for a dedicated conduit for each sprayer. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
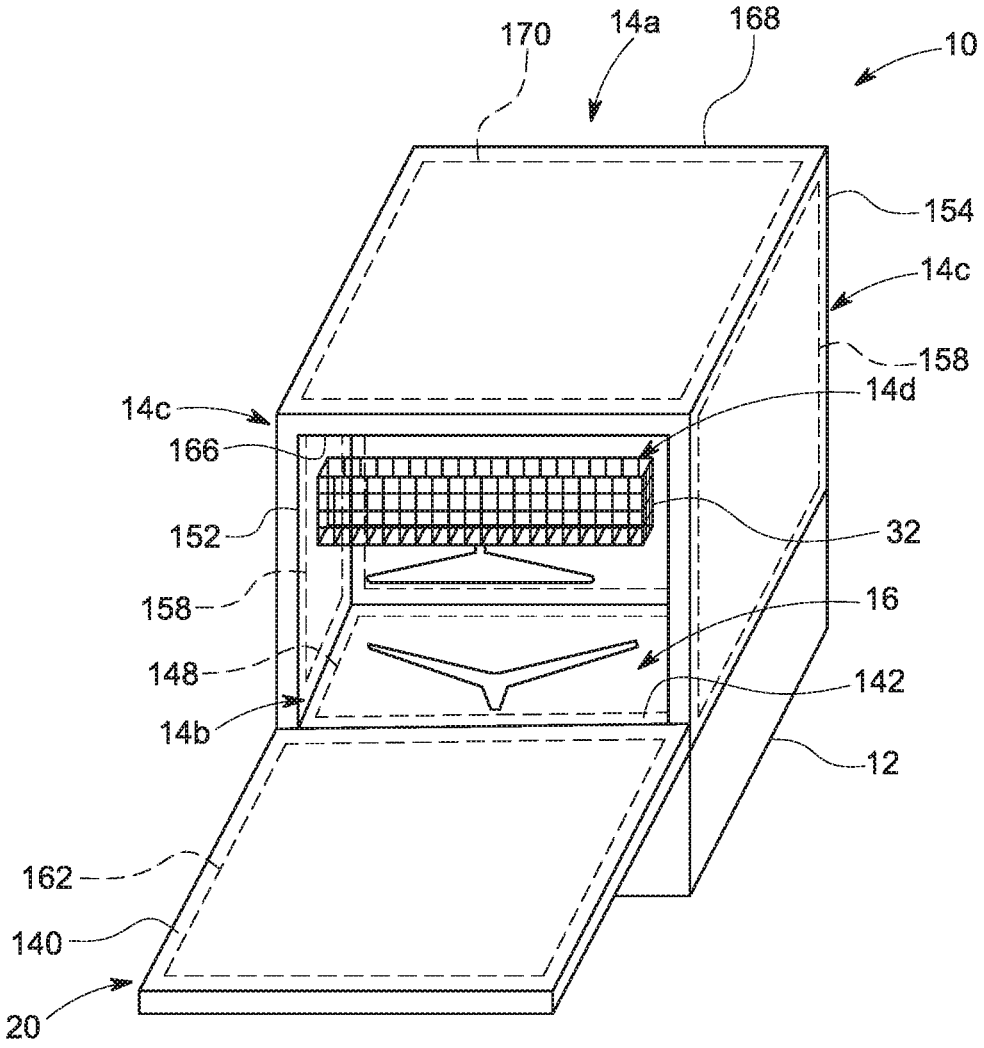
FIG. 3 is a schematic perspective view of the dishwasher of FIG. 1, with an open closure, in the form of a door assembly, and illustrating a variety of different spray impact zones.

FIG. 3 is a schematic perspective view of the dishwasher 10 with a closure, in the form of a door assembly 20, shown opened, and illustrates a variety of spray impact zones created by the impact of sprayed liquid on the side walls 14*c*, door 20, and top wall 14*a*, and a rainfall zone 148 on the bottom wall 14*b*. The lower dish rack 34 and the upper spray arm 41 have been removed to better see the spray impact zones. Looking at the spray impact zones in more detail, a first set of spray impact zones 158 are illustrated on the interior or inner surface of the side walls 14*c* and rear wall 14*d*. As the side walls and rear wall collectively define a peripheral wall, the several impact zones 158 can be thought of as a single impact zone for the peripheral wall. As illustrated the impact zones 158 are essentially coextensive with the peripheral wall. However, it is possible to refine these impact zones. In reality, the greatest noise comes from sprayed liquid that is emitted from the sprayer and directly contacts with the wall, without first hitting the corresponding rack or dishes located in the rack. In the case of an empty rack, the impact zone will, to some extent, be essentially a band extending along the peripheral wall at essentially the same height or slightly greater height than the projection of the dishrack onto the peripheral wall. The number of sprayers, thus, will control the number of impact zones and the extent of the impact zones.

Another spray impact zone 162 is shown on the inside surface 160 of the door 20. The impact zone 162 is created in the same manner as the impact zones 158, which is, the impact zone 162 is a function of the number and location of sprayers. Thus, as with the impact zones 158, the impact zone 162, while shown as a single large area, can be refined into several smaller areas corresponding to the different sprayers and their spray pattern when impacting the door, when the door is closed.

Yet another impact zone 170 is shown on an inner surface of the top wall 14*a*. The impact zone 170 is created primarily from spray emitted by the upper spray arm 41, which passes through the upper rack 32, untouched, and then impacts the top wall 14*a*.

A rainfall zone 148 is shown on the bottom wall 14*b*. In most cases the rainfall zone will be substantially coextensive with the bottom wall 14*b* because the liquid impacting the bottom wall 14*b* comes from liquid running or dropping off the dishracks and the dishes in the dishracks. Such liquid tends to drip from all areas above the bottom wall 14*b*. That said, in many dishwashers, the bottom wall will have a sump assembly located in a cutout in the bottom wall. Water dripping on the sump assembly typically doesn't create as much sound as compared to water dripping on the bottom wall, primarily because the sump assembly is more massive and/or much of it is made of plastic, whereas the bottom wall 14*b*, as well as the side wall 14*c* and top wall 14*a*, are thinner materials, often made of metal, which can vibrate in a manner similar to a batter head of a drum. The amount of damping controls the duration that thinner materials can vibrate is the amount of damping. "Lightly" damped materials can have a tendency to vibrate easier and for longer periods of time than "heavily" damped materials. As the sump, when separate from the lower wall, is often made of thicker material or non-metal as compared to the bottom wall, the rainfall zone can have a portion that excludes the location of the sump assembly.

To address the sound associated with the impact zones and the rainfall zone, mastic has previously been applied to all sides of the tub as part of the tub manufacturing process. As mastic must be heat treated (baked on), it is typically best suited for metal tubs. However, mastic alone has not been sufficient to meet the sound level standards for high end dishwashers, which typically requires an overall sound level of 38 dB (A), which is currently considered the gold-standard for high end dishwashers. It has been found that the application of constrained layer damping (CLD) material on the tub and door, especially at the impact zones 158, 162, 170 and the rainfall zone 148 will yield a dishwasher with an overall sound level of 38 dB (A) or less. FIGS. 4-8 illustrate the use of CLD and specifically the location of the CLD material for the different impact zones and rainfall zones.

Figure 4:
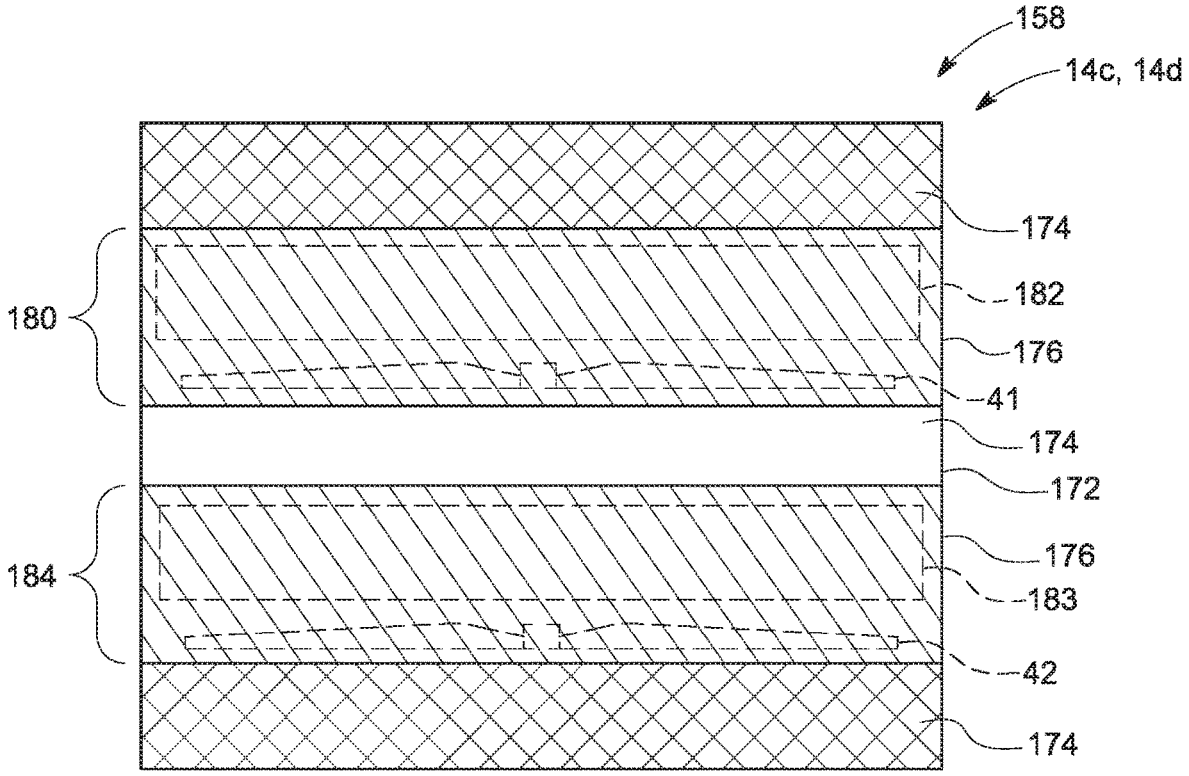
FIG. 4 is a schematic side view of the dishwasher of FIG. 3 and illustrating sound attenuation material in relation to some of the spray impact zones.

FIG. 4 illustrates a schematic side view for any of the side walls 14*c* or rear wall 14*d*. The first impact zone 158 is shown as being more refined and formed by two separate zones 180 and 184. As can be seen, these zones substantially correspond to the racks 28, 32, 34 and their corresponding sprayers 41, 42, 43. The CLD material 176 is shown as coextensive with each of the refined first impact zones 180, 184. While only one of the side walls 14*c* is shown, as FIG. 4 is applicable to all of the side walls 14*c*, it should be understood that the impact zones 158, 180, 184, etc., will wrap around the peripheral wall.

In FIG. 4, and all the drawings for that matter, the CLD material is represented by the angled shade lines. Optionally, the CLD can overlie a layer of mastic 174, shown with cross-hatched shading. While the mastic material is shown as overlying the entire wall 14*c*, 14*d*, the mastic could be limited to the first impact zones 180, 184 in the same manner as the CLD material.

The mastic 174 is a sound deadening material that provides mass and damping to the metal, which can reduce the amplitude of the sound wave generated at the impact zone, due to vibration via a fluid structure interaction. Additionally, the mastic can act as an acoustic barrier because an increase in the surface mass is provided by the metal and mastic combination. The increase in the surface mass can allow the surface to "reflect" the sound waves generated inside of the appliance (e.g. the water impacting the dishes) back inside the dishwasher. The "reflection" of sound essentially traps a majority of the sound inside the chamber 16 of the dishwasher 10. Specifically, but not limited to, the mastic 174 can deaden lower octave noises like motor and wash sounds. The minority of sound that cannot be trapped inside the chamber 16 can allow the mastic 174 to transform the sound energy into heat. The mastic 174 can act similar to a heat sink, and dissipate the heat. The rest of the sound energy that is transmitted through the absorbing body can travel through the mastic 174 in the form of a sound wave, which can result in airborne sound.

Thus, CLD 176 is used to minimize the amplitude of the airborne sound through additional damping. CLD 176 can include at least three layers consisting of but not limited to a rigid outer metal layer, a damping material (usually comprising a visco-elastic membrane), and a high-tack adhesive layer, which are bonded together. The damping material can be designed to reduce structural vibration and sound transmission within light gauge materials like the materials used to form the tub 14 of the dishwasher 10. To achieve the high performance in reduction of vibration and sound, the damping material within the CLD is sheared as vibrations are formed due to water striking the impact zone. 176. The structure borne vibration causes the rigid material to shift in different directions. The shifting of the rigid material results in shear forces within the damping material to convert the energy from the shearing, to frictional energy. The frictional energy can therefore be converted into heat and dissipate.

Figure 5:
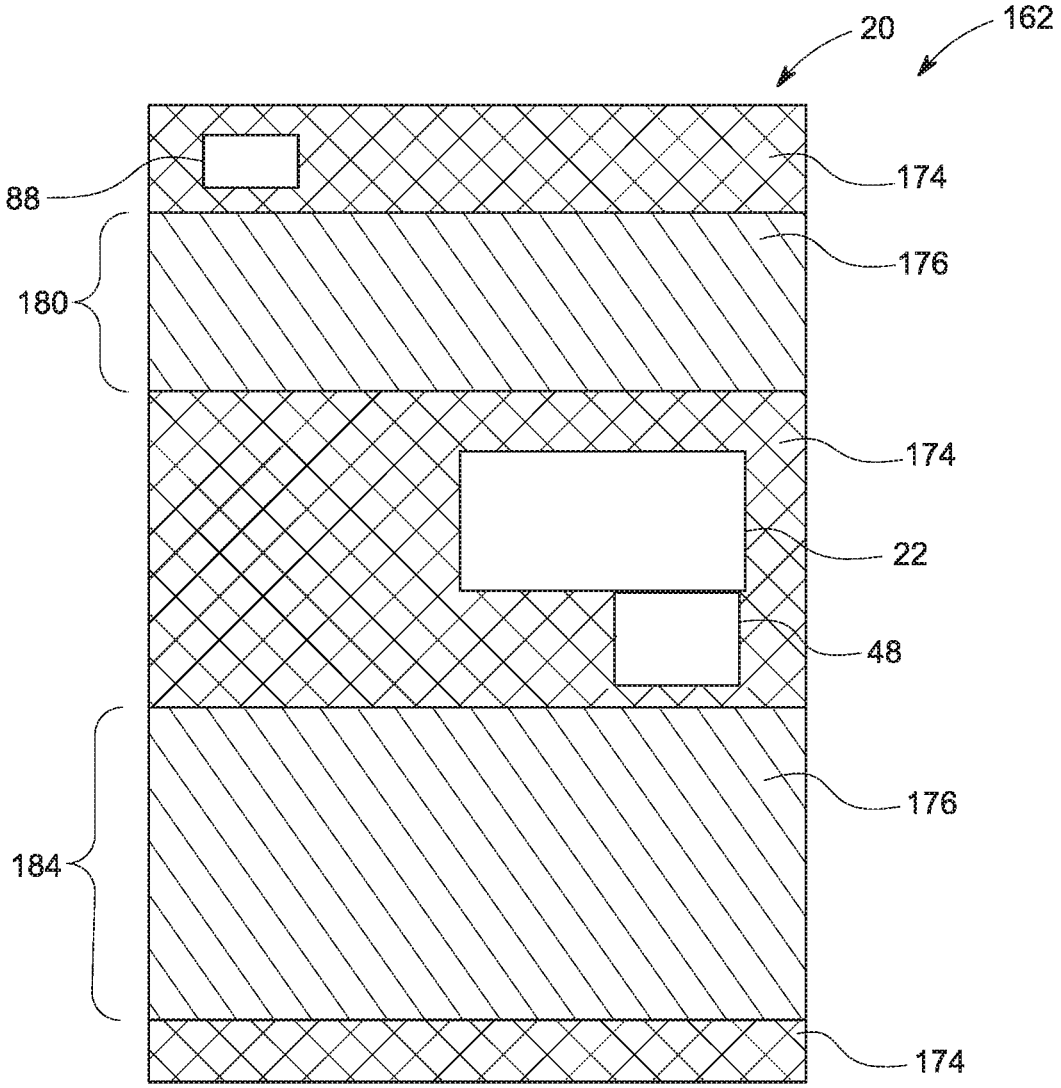
FIG. 5 is a schematic rear view of an inner panel of the door assembly of the dishwasher of FIG. 3.

FIG. 5 is a schematic rear view of an inner panel 192 of the door assembly 20 of the dishwasher 10 of FIG. 3. The second impact zone 162 is shown as being more refined and formed by two separate zones 180 and 184. As can be seen, these zones substantially correspond to racks 32, 34 and their corresponding sprayers 41, 42. The CLD material 176 is shown as coextensive with each of the refined first impact zones 180, 184. The CLD material is represented by the angled shade lines. Optionally, the CLD can overlie a layer of mastic 174, shown with cross-hatched shading. While the mastic material is shown as overlying the entire door assembly 20, the mastic could be limited to the zones 180, 184 in the same manner as the CLD material. It should be noted that the CLD material, and the mastic, for that matter, can surround and not overlie the components, such as the fan, controller, and dispenser. However, the CLD material could overlie some of these components, as long as it doesn't interfere with their normal operation.

Figure 6:
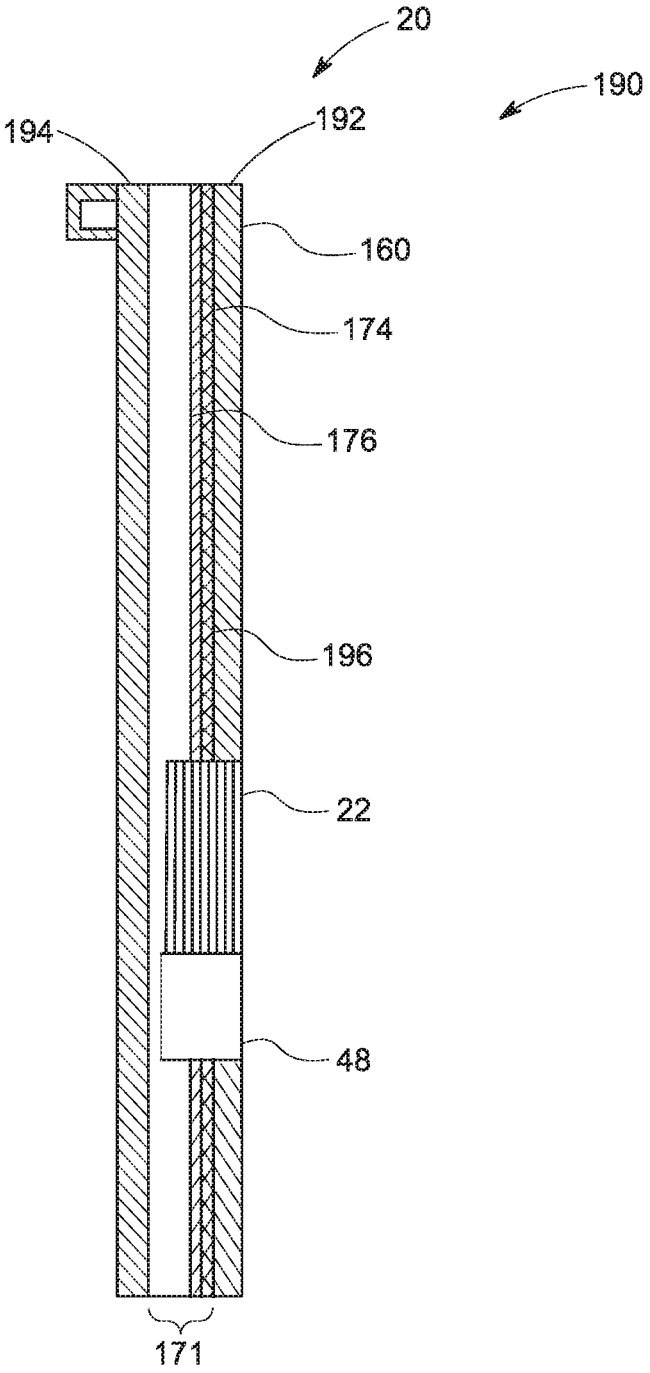
FIG. 6 is a schematic of a vertical cross section of the door assembly of FIG. 3.

FIG. 6 is a schematic of a vertical cross section of the door assembly 20 of FIG. 3. The door assembly 20 is shown as including an inner panel 192 and outer panel 194, which are in spaced relation to define an interior space 171, where components, such as the fan, controller, and dispenser are located. The inner panel 192 can include the inner door surface 160 facing the chamber 16. The inner panel 192 can also include the inner surface 196 facing the outer panel 194. The mastic layer 174 is mounted to the inner door surface 196. The CLD material 176 is coupled to the mastic layer 174 and/or coupled directly to the outer door surface 196. In some variations an insulation layer can also be included within the space 171 between the CLD 176 and the outer panel 194. The mastic layer 174, the CLD 176, and/or the insulation layer can wrap components within the door assembly 20, such as but not limited to the controller 22 and/or the dispensing assembly 48.

Figure 7:
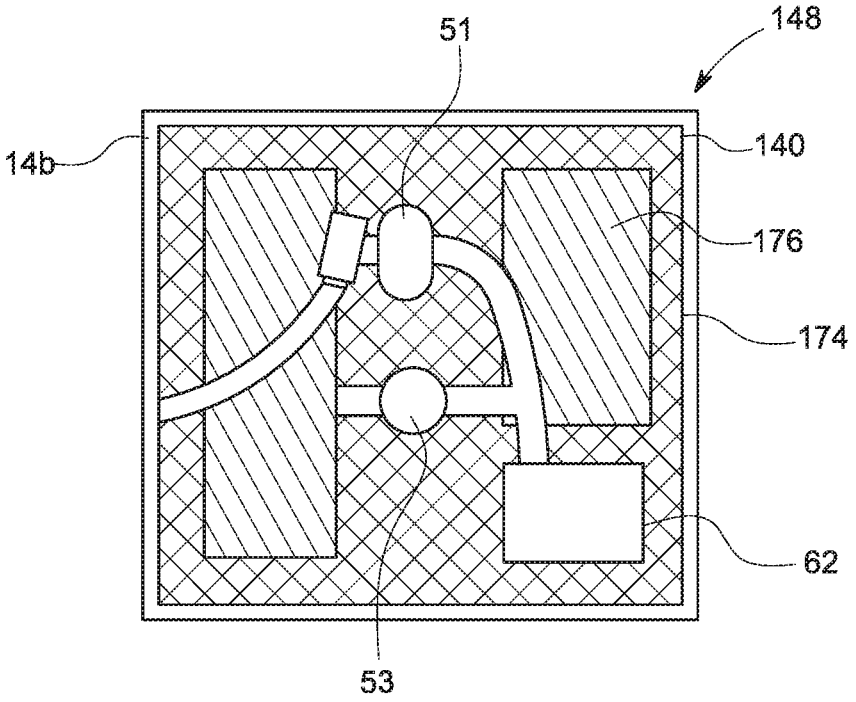
FIG. 7 is a schematic bottom view of the bottom wall of the dishwasher.

FIG. 7 is a schematic bottom view of the bottom wall 14*b* of the dishwasher 10. The rainfall zone 148 is shown as being more refined with respect to the sump 51, recirculation pump 53, and drain pump 62. The CLD 176 is represented by the angled shade lines. Optionally, the CLD 176 can overlie a layer of mastic 174, shown with cross-hatched shading. While the mastic material is shown as overlying the entire bottom wall 14*b*, the mastic 174 could be limited to specific zones in the same manner as the CLD 176 depending on the location of the components similar to the sump 51, recirculation pump 53, and the drain pump 62.

Figure 8:
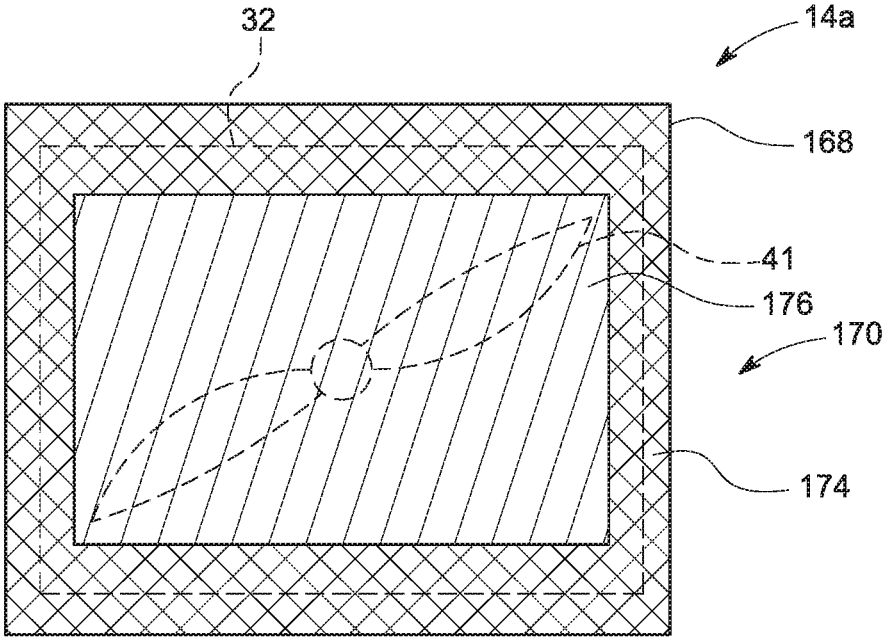
FIG. 8 is a schematic top view of an upper wall of the dishwasher.

FIG. 8 is a schematic top view of a top wall 14*a* of the dishwasher 10. The third spray zone 170 is shown as being defined by an outer upper wall surface 168. The CLD 176 is represented by the angled shade lines. Optionally, the CLD 176 can overlie a layer of mastic 174, shown with cross-hatched shading. While the mastic 174 is shown as overlying the entire top wall 14*a*, the mastic 174 could be limited to specific zones within the top wall 14*a*.

Further aspects of the disclosure are provided by the subject matter of the following clauses:

A dishwasher comprising a tub having at least an upper wall and a lower wall, with a side wall extending between the upper wall and lower wall, with the upper, lower, and side wall at least partially defining a treating chamber with an access opening, a cover selectively closing the access opening in response to relative movement between the cover and the tub, a dish rack located within the treating chamber, a liquid recirculation circuit having at least one sprayer emitting recirculated liquid into the treating chamber and defining a first spray impact zone on the side wall, a second spray impact zone on the cover, and a rainfall zone on the lower wall, and a constrained layer damping (CLD) material located at the first spray impact zone, second spray impact zone, and the rain fall zone.

The dishwasher of any of the preceding clauses wherein the first spray impact zone, second spray impact zone, and rainfall zone are on a respective inner surface of the side wall, cover, and lower wall.

The dishwasher of any of the preceding clauses wherein the first spray impact zone, second spray impact zone, and rainfall zone are on a respective outer surface of the side wall, cover, and lower wall.

The dishwasher of any of the preceding clauses wherein the cover comprises a door having an inner panel and an outer panel, and defining a space between the inner and outer panel, and the CLD material located at the second spray impact zone is located within the space.

The dishwasher of any of the preceding clauses wherein the inner panel has an inner surface confronting the treating chamber and an outer surface, opposite the inner surface, and the CLD material is located on the outer surface.

The dishwasher of any of the preceding clauses further comprising a mastic layer located at at least one of the first spray impact zone, second spray impact zone, and rainfall zone.

The dishwasher of any of the preceding clauses wherein the respective CLD material overlies the mastic layer.

The dishwasher of any of the preceding clauses wherein a mastic layer is located at each of the first spray impact zone, second spray impact zone, and rainfall zone.

The dishwasher of any of the preceding clauses further comprising a third spray impact zone on the upper wall and a CLD material is located at the third spray impact zone.

The dishwasher of any of the preceding clauses wherein the CLD material is coextensive with at least one of the first spray impact zone, second spray impact zone, and rainfall zone.

The dishwasher of any of the preceding clauses wherein the tub is made from metal.

The dishwasher of any of the preceding clauses wherein at least a portion of the cover confronting the treating chamber is made of metal.

A dishwasher comprising a metal tub having at least an upper wall and a lower wall, with a side wall extending between the upper wall and lower wall, with the upper, lower, and side wall at least partially defining a treating chamber with an access opening, a hingedly mounted door selectively closing the access opening in response to relative movement between the cover and the tub, a lower dish rack located within the treating chamber above the lower wall, an upper dish rack located within the treating chamber above the lower dish rack, a liquid recirculation circuit having a lower sprayer located below the lower dish rack, an upper sprayer located below the upper dish rack and above the lower dish rack, with each of the lower and upper sprayers emitting recirculated liquid into the treating chamber and defining a first spray impact zone on the side wall, a second spray impact zone on the cover, and a rainfall zone on the lower wall, and a constrained layer damping (CLD) material located at the first spray impact zone, second spray impact zone, and the rain fall zone.

The dishwasher of any of the preceding clauses further comprising a third level rack located above the upper rack and the liquid recirculation circuit has a third level sprayer emitting a spray of liquid into the third level rack and defining a third impact zone on the upper wall.

The dishwasher of any of the preceding clauses wherein the first spray impact zone, second spray impact zone, and rainfall zone are on a respective inner surface of the side wall, cover, and lower wall.

The dishwasher of any of the preceding clauses wherein the first spray impact zone, second spray impact zone, and rainfall zone are on a respective outer surface of the side wall, cover, and lower wall.

The dishwasher of any of the preceding clauses wherein the cover comprises a door having an inner panel and an outer panel, and defining a space between the inner and outer panel, and the CLD material located at the second spray impact zone is located within the space.

The dishwasher of any of the preceding clauses wherein the inner panel has an inner surface confronting the treating chamber and an outer surface, opposite the inner surface, and the CLD material is located on the outer surface.

The dishwasher of any of the preceding clauses further comprising a mastic layer located at least one of the first spray impact zone, second spray impact zone, and rainfall zone and the CLD material overlies the mastic layer.

The dishwasher of any of the preceding clauses wherein the CLD material is coextensive with at least one of the first spray impact zone, second spray impact zone, and rainfall zone.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher comprising:

a tub having at least an upper wall and a lower wall, with a side wall extending between the upper wall and lower wall, with the upper, lower, and side wall at least partially defining a treating chamber with an access opening;

a cover selectively closing the access opening in response to relative movement between the cover and the tub;

a dish rack located within the treating chamber;

a liquid recirculation circuit having at least one sprayer emitting recirculated liquid into the treating chamber and defining a first spray impact zone on the side wall, a second spray impact zone on the cover, and a rainfall zone on the lower wall; and a constrained layer damping (CLD) material located at the first spray impact zone, second spray impact zone, and the rainfall zone and a majestic layer located at at least one of the first spray impact zone, second spray impact zone, and rainfall zone.

2. The dishwasher of claim 1 wherein the first spray impact zone, second spray impact zone, and rainfall zone are on a respective inner surface of the side wall, cover, and lower wall.

3. The dishwasher of claim 1 wherein the cover comprises a door having an inner panel and an outer panel, and defining a space between the inner and outer panel, and the CLD material located at the second spray impact zone is located within the space.

4. The dishwasher of claim 3 wherein the inner panel has an inner surface confronting the treating chamber and an outer surface, opposite the inner surface, and the CLD material is located on the outer surface.

5. The dishwasher of claim 1 wherein the respective CLD material overlies the mastic layer.

6. The dishwasher of claim 5 wherein a mastic layer is located at each of the first spray impact zone, second spray impact zone, and rainfall zone.

7. The dishwasher of claim 1 further comprising a third spray impact zone on the upper wall and a CLD material is located at the third spray impact zone.

8. The dishwasher of claim 1 wherein the CLD material is coextensive with at least one of the first spray impact zone, second spray impact zone, and rainfall zone.

9. The dishwasher of claim 1 wherein the tub is made from metal.

10. The dishwasher of claim 9 wherein at least a portion of the cover confronting the treating chamber is made of metal.

11. A dishwasher comprising:

a metal tub having at least an upper wall and a lower wall, with a side wall extending between the upper wall and lower wall, with the upper, lower, and side wall at least partially defining a treating chamber with an access opening;

a hingedly mounted cover selectively closing the access opening in response to relative movement between the cover and the tub;

a lower dish rack located within the treating chamber above the lower wall;

an upper dish rack located within the treating chamber above the lower dish rack;

a liquid recirculation circuit having a lower sprayer located below the lower dish rack, an upper sprayer located below the upper dish rack and above the lower dish rack, with each of the lower and upper sprayers emitting recirculated liquid into the treating chamber and defining a first spray impact zone on the side wall, a second spray impact zone on the cover, and a rainfall zone on the lower wall; and a constrained layer damping (CLD) material located at the first spray impact zone, second spray impact zone, and the rainfall zone, and a mastic layer located at at least one of the first spray impact zone, second spray impact zone, and rainfall zone and the CLD material overlies the mastic layer.

12. The dishwasher of claim 11 further comprising a third level rack located above the upper dish rack and the liquid recirculation circuit has a third level sprayer emitting a spray of liquid into the third level rack and defining a third impact zone on the upper wall.

13. The dishwasher of claim 11 wherein the first spray impact zone, second spray impact zone, and rainfall zone are on a respective inner surface of the side wall, cover, and lower wall.

14. The dishwasher of claim 11 wherein the cover comprises a door having an inner panel and an outer panel, and defining a space between the inner and outer panel, and the CLD material located at the second spray impact zone is located within the space.

15. The dishwasher of claim 14 wherein the inner panel has an inner surface confronting the treating chamber and an outer surface, opposite the inner surface, and the CLD material is located on the outer surface.

16. The dishwasher of claim 11 wherein the CLD material is coextensive with at least one of the first spray impact zone, second spray impact zone, and rainfall zone.

* * * * *